United States Patent [19]

Parmer

[11] Patent Number: 5,074,807

[45] Date of Patent: Dec. 24, 1991

[54] COMPONENT HOLDING DEVICE

[75] Inventor: Kenneth R. Parmer, Harrisburg, Pa.

[73] Assignee: AMP Incorporated, Harrisburg, Pa.

[21] Appl. No.: 621,407

[22] Filed: Dec. 3, 1990

[51] Int. Cl.[5] ..... H01R 13/73

[52] U.S. Cl. ..... 439/553; 439/557

[58] Field of Search ..... 439/544, 547, 548, 552, 439/560, 564, 565, 570, 573, 562, 569, 571, 82

[56] References Cited

U.S. PATENT DOCUMENTS

| | | | |
|---|---|---|---|
| 2,764,751 | 9/1956 | Gnadke | 439/552 |
| 3,659,243 | 4/1972 | Gluntz | 339/192 R |
| 4,142,810 | 3/1979 | Lesaint | 439/557 |
| 4,435,031 | 3/1984 | Black et al. | 439/82 |
| 4,457,573 | 7/1984 | Bailey et al. | 439/557 |
| 4,461,537 | 7/1984 | Raymer, II et al. | 350/96.20 |
| 4,477,142 | 10/1984 | Cooper et al. | 339/125 R |
| 4,639,066 | 1/1987 | Shimamiya et al. | 339/132 B |
| 4,679,883 | 7/1987 | Assini et al. | 439/607 |
| 4,681,389 | 7/1987 | Nakazawa et al. | 439/557 |
| 4,693,532 | 9/1987 | Colleran et al. | 439/594 |
| 4,717,219 | 1/1988 | Frantz et al. | 439/82 |
| 4,721,473 | 1/1988 | DelGuidice et al. | 439/79 |
| 4,735,587 | 4/1988 | Kirayogiu | 439/751 |
| 4,847,588 | 7/1989 | Doutrich | 439/751 |
| 4,907,987 | 3/1990 | Douty et al. | 439/571 |

FOREIGN PATENT DOCUMENTS

| | | | |
|---|---|---|---|
| 0180284 | 5/1986 | European Pat. Off. . | |
| 2628617 | 1/1977 | Fed. Rep. of Germany | 439/557 |
| 7914042 | 5/1979 | Fed. Rep. of Germany . | |
| 7710543 | 11/1978 | France . | |
| 51-83793 | 7/1976 | Japan . | |
| 2058485 | 12/1981 | United Kingdom . | |

*Primary Examiner*—Neil Abrams
*Assistant Examiner*—Hien D. Vu
*Attorney, Agent, or Firm*—Katherine A. Nelson

[57] ABSTRACT

A holding device (24) operates to hold a component such as a connector (16) to a printed circuit board (12) through a pair of spring driven projections (30, 40) having barbs (34, 44) engaging interior surfaces (14, 20, 22) of the component and board. Releasible versions (50, 80) facilitate closure by a tool to remove barbs from the components and allow separation of elements.

8 Claims, 5 Drawing Sheets

Fig. 7A
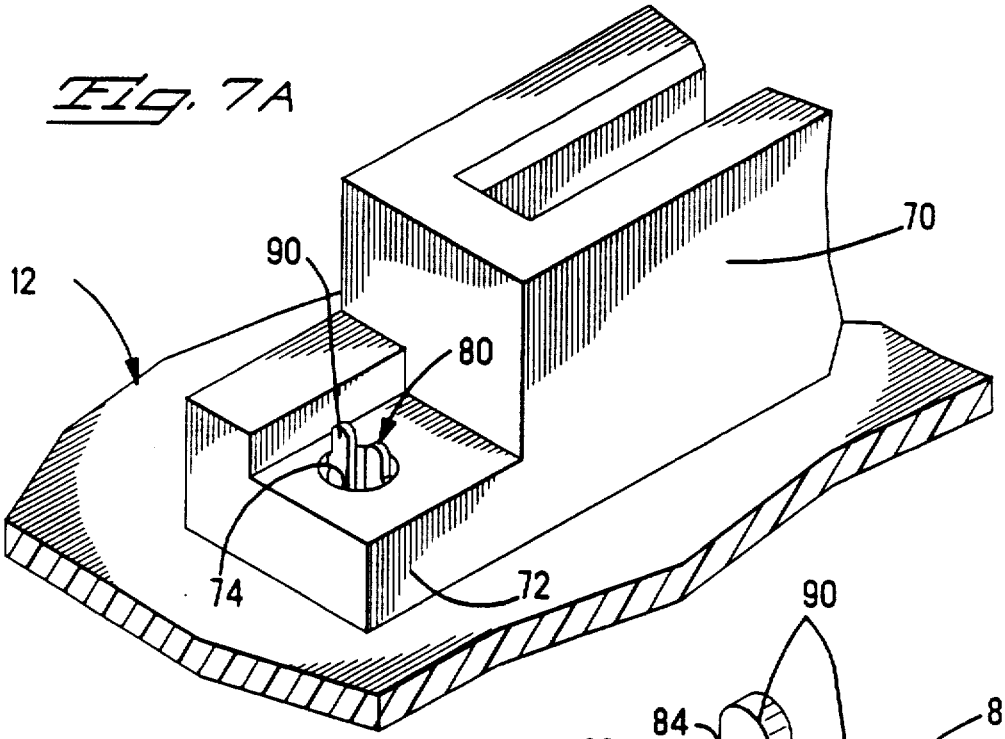
Fig. 8
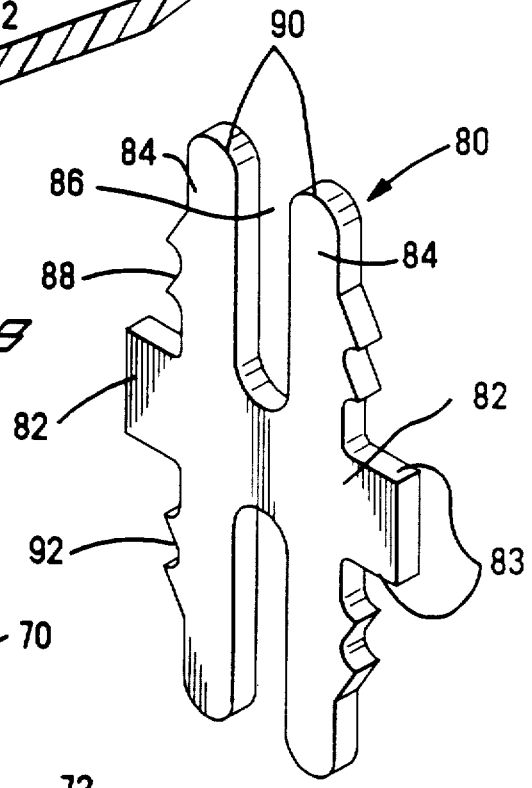
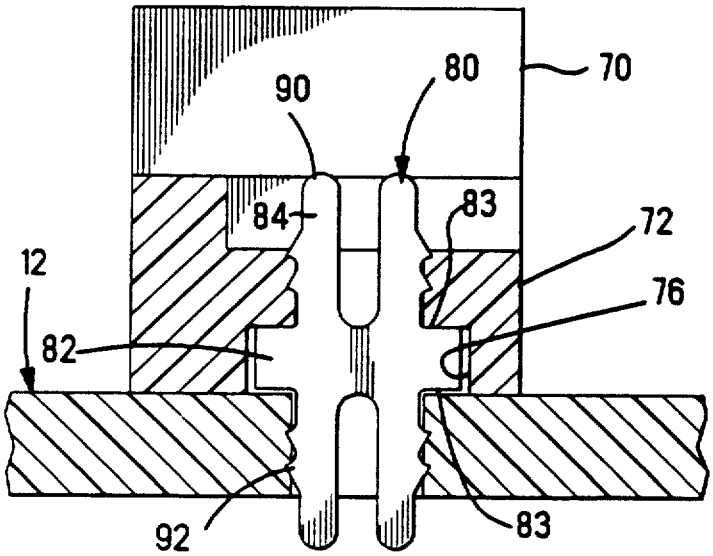
Fig. 7B

COMPONENT HOLDING DEVICE

This invention relates to a device for locking and/or latching components such as electrical connectors together and/or latching components to printed circuit boards.

BACKGROUND OF THE INVENTION

U.S. Pat. No. 4,907,987 granted Mar. 13, 1990 and directed to a connector with barbed board lock teaches a metal stamping having barbs supported by spring elements intended to bite into the interior wall surfaces of printed circuit board holes and lock a connector thereto. The patent teaches a variety of constructions for locking such components together and cites a number of U.S. and foreign patent documents related to locking components together and to barbed retention devices.

An object of the present invention is to provide an improved board lock device and further an improved device for locking or latching components together. A further object is to provide a cost effective readily manufacturable and easily used holding device to hold two plastic parts together.

A still further object is to provide a novel, releasable latch for holding parts together with means to facilitate a release of such parts.

SUMMARY OF THE INVENTION

The present invention teaches a component holding device in a number of embodiments that include a planar stamped sheet metal member having projecting portions slotted to define spring beams extending from a center projection having horizontal surfaces to engage the horizontal surfaces of components to be held together. The spring beams are each positioned relative to radially extending barbs so as to be deflected when the device is fitted within the aperture or hole in components pressed relative together to lock and/or latch such components in fixed relationship. In one embodiment, the spring beams are made continuous through the length of the device to facilitate a radially inward disposition withdrawing the barbs of the device from engagement with the components to provide such components with release. In another embodiment, one of the components is provided with a cavity accessible from the side to facilitate a reduction in board space of a component relative to a printed circuit board. In still another embodiment, the device is made to include projections extending from the spring beams to allow inward deformation to release one or both of the components from the device.

IN THE DRAWINGS

FIG. 7A is a perspective showing components held together with a device in accordance with a further embodiment of the invention.

FIG. 7B is a side, elevational view of he connector of FIG. 7A in partial section.

FIG. 8 is a perspective of the device shown in FIG. 7.

DETAILED DESCRIPTION OF THE INVENTION

Figure 1:
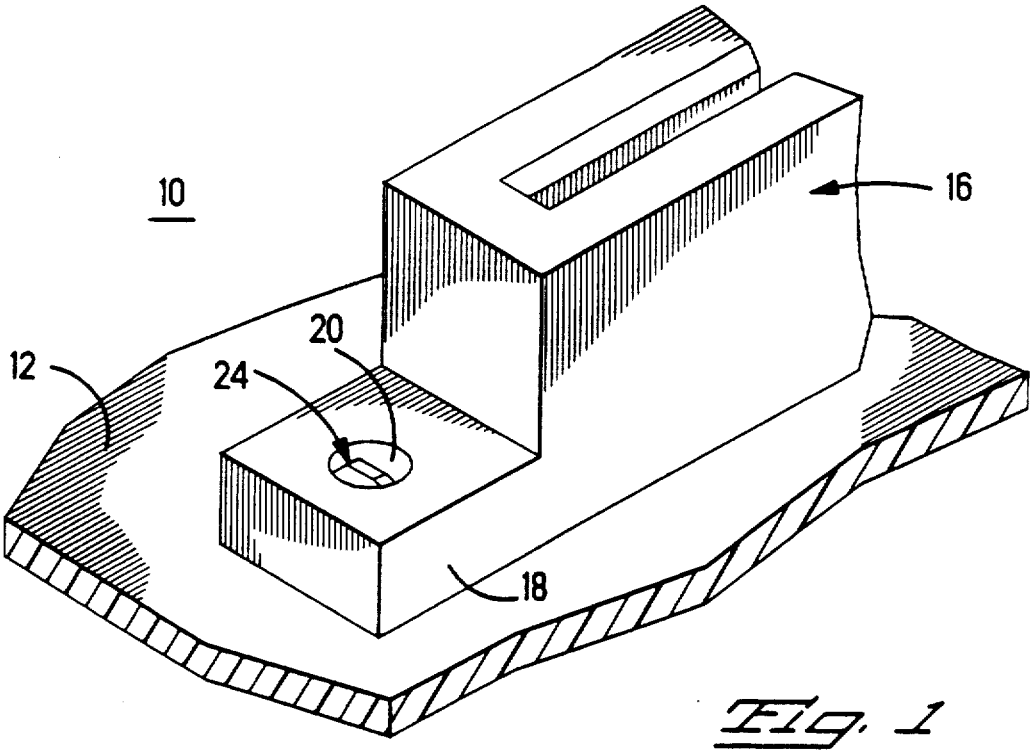
FIG. 1 is a perspective showing portions of two components locked together.
Figure 2:
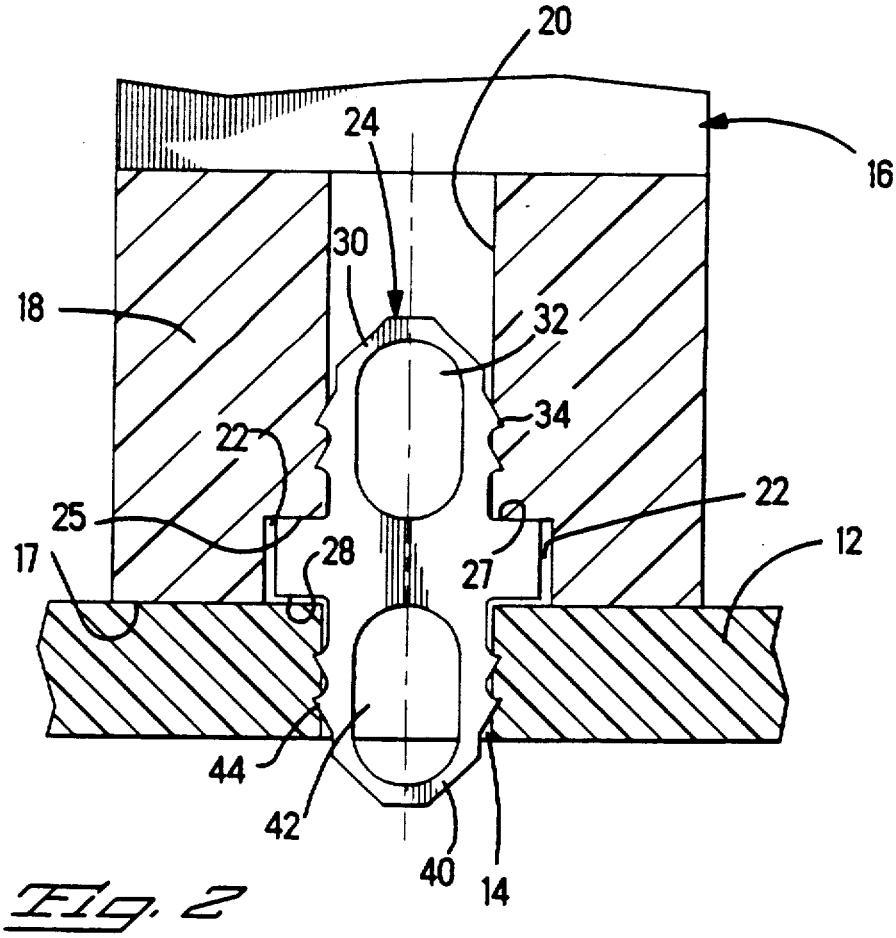
FIG. 2 is an elevational and partially sectioned view of the components of FIG. 1.
Figure 3:
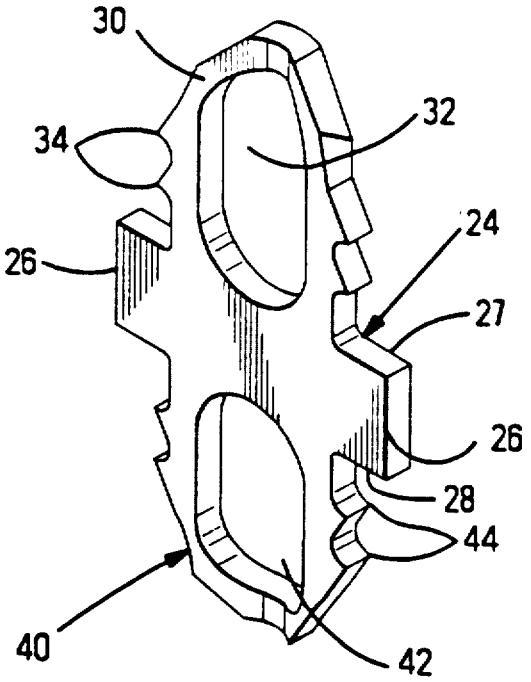
FIG. 3 is a perspective of a holding device in accordance with the invention in one embodiment.

Referring now to FIG. 1, an assembly 10 includes a printed circuit board 12, a component 16 mounted and held thereon through the engagement with a holding device 24 fitted into a flange 18 of the component 16. For purposes of illustration, the invention is shown to secure a card edge connector of a type adapted to receive a daughter card (not shown) and to interconnect the pads thereof to terminals, (also not shown), which in turn are electrically joined to circuit traces within board 12. The invention contemplates a positioning, aligning, and holding of the components together. As best seen in FIG. 2, flange 18 of component 16 includes at least one "T" shaped aperture extending therethrough having the cross bar sections 22 of the "T" being proximate and open to board mounting surface 17 of component 16. Board 12 includes an aperture 14 extending therethrough and aligned with each corresponding apertures 20 of component 16. The width or radial dimensions of these apertures is controlled to define surfaces engaged by the holding device 24 as shown in FIGS. 1 through 3. As can be discerned particularly from FIG. 3, the holding device 24 includes a center projection 26 having a plurality of horizontal surfaces 27,28 extending on the upper and lower surfaces respectively thereof. Extending upwardly from projections 26 is a further projection 30 having slot 32 and further having radially extending barbs 34 extending on either side thereof proximate the slotting. A lower projection 40 includes a slot 42 extending therealong and radially extending barbs 44 extending from either side thereof. The device 24 is preferably stamped and formed of sheet metal stock of a sufficient thickness and hardness to serve as a holding device by virtue of the barbs thereon biting into and engaging the interior surfaces of apertures 20 and 14 of the component 16 and board 12 respectively of the assembly. Materials such as brass or phosphor bronze or stainless steel may be employed with thicknesses ranging on the order from 0.012 to 0.025 inches in thickness. The dimensions of slots 32,42 depend primarily upon the thickness and strength of the material used to made device 24. The slots 32,42 must be sufficiently large enough to allow inward deformation of projections 30 and 40 in the region of the barbs 34,44 respectively to provide an elastic spring action holding the respective barbs in engagement with the interior surfaces of aperture 20,14 of the component 16 and board 12, as shown in FIG. 2. In accordance with the invention, the lower surfaces 28 of the projections 26 lie proximate the upper horizontal surface of the board 12 and upper surfaces 27 of projections 26 lie against the interior horizontal surface 25 of the component 16 as shown in FIG. 2. In use, the surfaces 27,28 perform the vital function of positioning the holding device 24 precisely in a vertical direction relative to components 16 and board 12. Thus, the device 24 including the projection 40 is positioned precisely in component 16 by the engagement with the upper surface 27 and lower surface 28 prevents device 24 from being overdriven or accidentally displaced downward within the aperture 14. Thus also, the component 16, once seated with the barbs 34 engaging the interior surfaces of 20, can readily be seated with the interior surfaces 25 engaging the upper surfaces 27 of the projection 26.

In accordance with the invention, the length of the projections 30 and 40 may be varied, the width of such projections may be varied, and the slots 32 and 42 may be varied in width and in length; all to provide a differential action and geometries which are different for the components 16 and board 12. In addition, since boards used with device 24 may be of varying thickness, it may be desirable to adjust the position or size the barbs 44 to insure adequate retention by the interior surfaces of board aperture 14. Similar adjustments may also be made with respect to locating projection 32 in component aperture 20.

Figure 4:
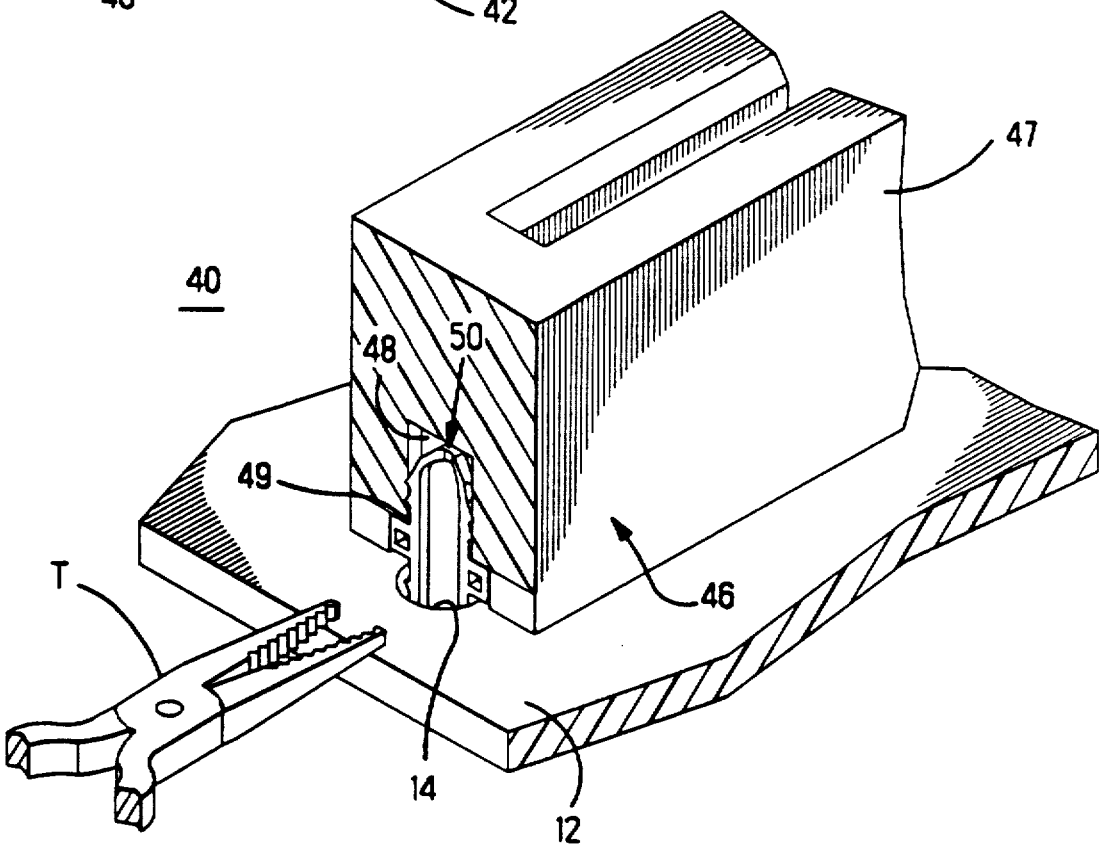
FIG. 4 is a perspective showing components held together by a holding device of the invention in accordance with a further embodiment.
Figure 5:
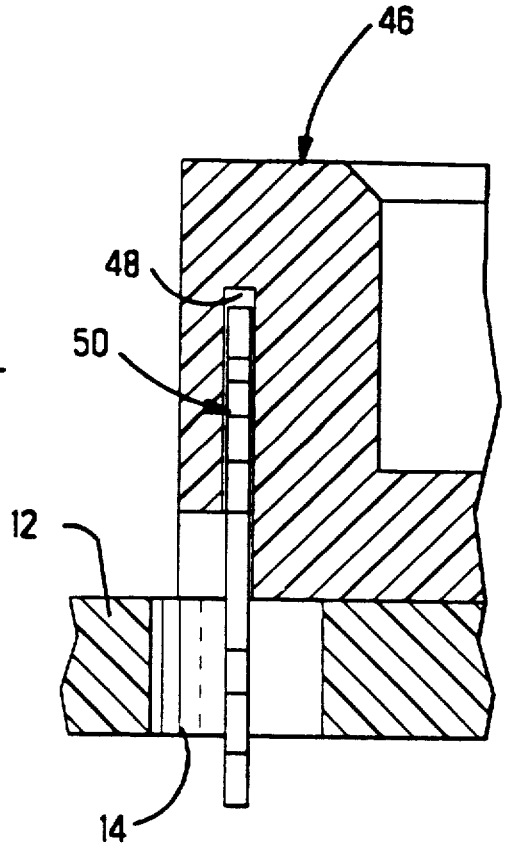
FIG. 5 is a side elevational view in partial section of the device shown in FIG. 4.

FIG. 4 shows an alternative embodiment of the invention wherein an assembly 40 includes a circuit board 12 having the aperture 14 therein, as previously described, and a component 46 fastened to board 12. As can be discerned in FIGS. 4 and 5, the component 46 includes at the ends thereof a T-shaped relief or cavity 48 defined within the volume of housing 47 of component 46. Each cavity 48 including cross bar sections 49 as shown in FIG. 4 is adapted to receive a holding device 50 more particularly shown in FIG. 6. The holding device 50 is similar to device 24 shown in Figure and includes a horizontal projection 52 having apertures 54 therein and a continuous vertically extending slot 56 which extends into projections 58 and 62. The projections 58,62 include barbs 60, 64 respectively extending radially outwardly and dimensioned to bite into the interior surfaces of aperture 14 in board 12 and aperture 48 in component 46. When the component 46 is assembled to board 12, the barbs are driven inwardly in a resilient and elastic deformation partially closing slot 56 to maintain the respective barbs 60,64 in engagement and hold component 46 and board 12 together. In accordance with the invention embodiment shown in FIGS. 4–6, the use of the apertures 54 in horizontal projections 52 allows the insertion of a tool T in FIG. 4, a tool such as needlenose pliers into the apertures 54. Closure of the tool T will compress the slot 56 inwardly to disengage the barbs 60 and 64 and allow separation of one end of the component 46 from board 12. The other end of component 46 may include a similar holding device 50, which then can be released in a similar fashion to remove the component 46 from the board 12. In general, components such as 16 and 46 may very well include a terminal which is soldered within apertures of the board or surface mounted by solder. In such cases, removal of the components or separation of the components may be seldom done except for repair of damaged components or defective components. Alternatively, the invention contemplates the joining of components wherein the engagement therebetween is of a characteristic allowing ready removal and replacement. For example, the terminals may contain spring fingers which engage the board and are not soldered. Alternatively, a variety of conductive gels and adhesives are presently being employed wherein separation of the components can be expected more frequently. In other words, one of the components may be a disengageable connector which utilizes a version of the holding device to latch and hold the components together but to allow ready removal and separation of the components.

FIG. 7A shows an alternative embodiment wherein a component 70 is joined to board 12. Component 70 again illustrates an electrical connector of the type utilized to join daughter boards to mother boards. The component 70 includes a flange 72 having an aperture 74 therein which in the upper region is of a given diameter and in the lower region is, as shown in FIG. 7B, of a larger diameter and enumerated 76. The board 12 includes an aperture 14 as detailed in FIGS. 2 and 4. The components 70 and board 12 are latched together in this embodiment by a holding device 80 which is shown in FIG. 8 to include a central projection 82 defining horizontal surfaces 83 which engage the horizontal surfaces of board 12 and interior surface within flange 72 as defined by aperture 76. The holding device 80 further includes an upward projection 84 slotted at 86 and carrying thereon radially extending barbs 88. The upper part of projection 84 includes further portions 90 which, as shown in FIG. 7, protrude above the upper surface of flange 72 of component 70. The device 80 includes a projection 92 essentially identical to and extending oppositely from the projection 84. In accordance with the invention, the holding device 80 may be positioned with the projection 92 fitted within the aperture 14 of board 12 and the projection 84 fitted within the aperture 74 of component 70 to latch the two components together. The surfaces 83 limit the relative displacement of 80 and fix the positioning of the respective barbs of the two projections 84,92 in their respective apertures. Furthermore, following a latching of the components together, the components may be separated by the use of a tool such as that shown in FIG. 4, squeezing the projections 84 inwardly to collapse the slot 86 and remove barbs 88 from the interior surfaces of 74. The component 70 can thus be removed from board 12. As in the previous examples of holding devices such as 24 and 50, the invention contemplates that the different projecting ends of device 80, ends 84 and 92, may be given different geometries to provide different holding strengths relative to the characteristics of the components being joined together; namely, the particular plastic material used, and the particular thickness of the components with respect to engagement with the device.

Figure 6:
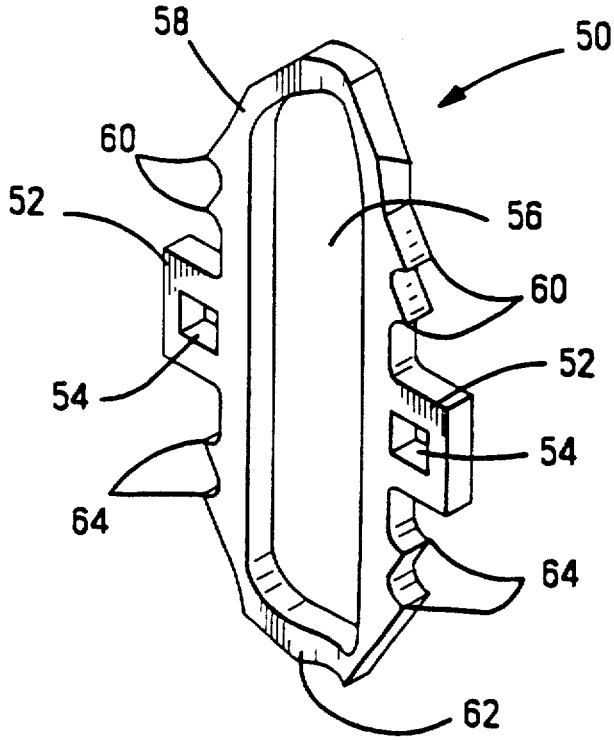
FIG. 6 is a perspective of the device of the invention shown in FIGS. 4 and 5.
Figure 9:
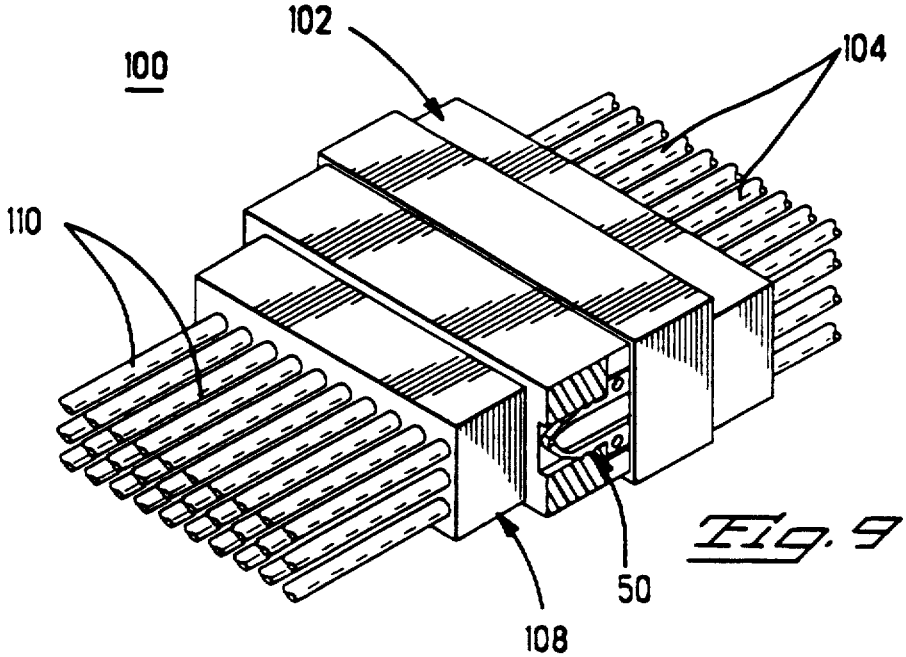
FIG. 9 is a perspective showing components held together utilizing the invention device of FIG. 6.
Figure 10:
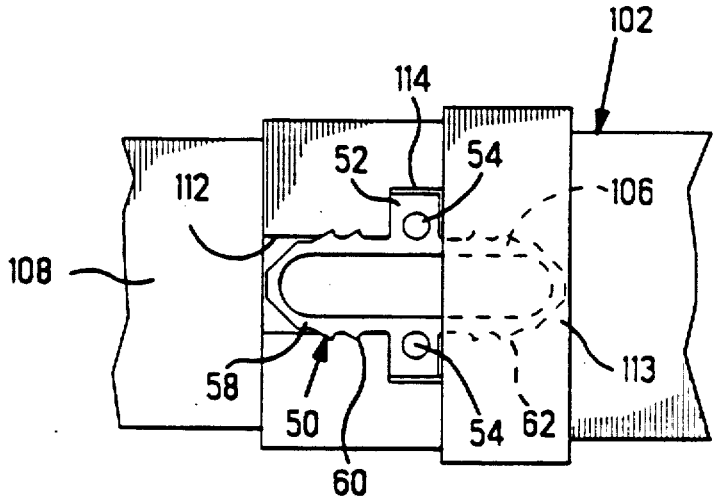
FIG. 10 is a side elevational view of the components shown in FIG. 9 including the device of FIG. 6 and including a partially phantom view.

FIG. 9 shows an alternative use of the invention wherein a connector assembly 100 is latched together by the use of an embodiment of the device 50 as shown in FIG. 6. The assembly 100 includes a plastic housing 102 carrying wire leads 104 to be joined to terminals within the housing 102 and to further terminals (not shown) within a housing 108 carrying leads 110 to be connected to lead wires 104. The ends of the housings 102 and 108 are, as shown in FIG. 10, made to include cavities adapted to receive the holding device 50. With respect to the housing 108, the cavity 112 having a further portion 114 of larger dimension is open at the end of the housing 108 whereas the cavity 113 in housing 102 is closed at the ends of the housing 102. FIG. 10 shows these cavities 112,113 receiving holding device 50 with the projection 52 fitted within the cavity 114 and the other projections 58 and 62 respectively extending into the housing cavities 112,113 with the barbs 60 and 64 biting into the interior directed surfaces of the housings 108,102 to latch the two housing halves together. As can be discerned from FIGS. 9 and 10, the holding device 50 may be manipulated by being compressed through engagement of the apertures 54 inwardly by a tool such as the grip tool shown as FIG. 4 to allow release of the holding device so as to separate the component connector halves 102 and 108.

Figure 11:
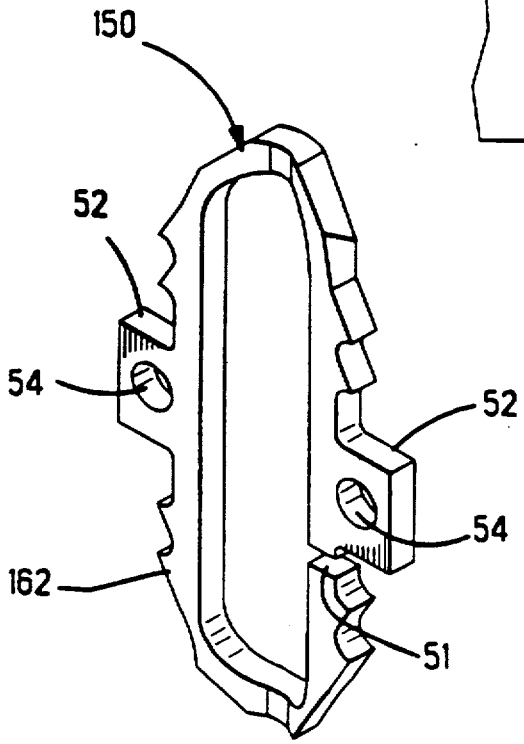
FIG. 11 is a perspective of a holding device of a further embodiment.

FIG. 11 shows a modification of the holding device in the form of 150 which is essentially identical to device 50 with the exception of having the lower projection 62 severed at 51. A device such as 150 when utilized in joining connector halves as shown in FIGS. 9 and 10 will result in the device 150 remaining fixed within a given connector half such as connector half 102, since inward deformation utilizing apertures 54 will not effect movement of both sides of projection 62.

Having now described the invention in terms intended to enable a preferred practice thereof in several embodiments, claims are set forth intended to define what is inventive.

I claim:

1. A holding device for holding electrical components together comprising a one-piece flat metal member including first and second axially extending projections each having a barb means extending radially outward therefrom and spring means operable to bias said barbs outwardly, the said first and second projections extending to fit within cavities in components to be held together, said cavities being dimensioned to receive said projections and engage the barbs thereof through the internal surfaces of said cavities to lock said projections and said device to each of said components and lock said components together in an axial sense, the said device including a third projection joined to each of the first and second projections and extending radially therebetween to define horizontal surfaces positioned to engage horizontal surfaces of the said components to limit axial movement of said device relative to said components, said device further including a single common slot extending axially through the first, second, and third projections to define a resilient radially developed outward force driving said barbs into the surface of said cavities.

2. The device of claim 1 wherein the said third projection includes means thereon facilitating a deformation of said device radially inwardly to collapse said slot and remove said barbs from said first and second projections from the surfaces of said cavity to allow separation of said components.

3. The device of claim 2 wherein one of said first or second projections includes a separation from said third projection such that upon deformation inwardly from said slot the projection containing the separation remains disposed radially outwardly to hold said device to the component surrounding such projection.

4. A device for holding components together of a type having axially extending cavities therein including a one-piece metal stamping having three projections including first and second projections each extending in an axial sense relative to said cavities and each including a slot therewithin defining radially resilient beams with each beam including a radially extending barb adapted to engage the interior surface of a slot within the component into which such projection is inserted with the beam biasing said barbs into said surfaces to hold said projection to said components, said slot extending commonly through the said three projections whereby the deformation inwardly of said slot draws the barbs on said projections radially inwardly to allow separation of said components, the third projection extending in a radial sense to define horizontal surfaces engaging horizontal surfaces of said components proximate said cavities to limit the displacement of said device in a given component whereby to hold said components together in a precise axial relationship.

5. The device of claim 4 wherein said first and second projections are each closed at the ends thereof by the material of which the projections are formed.

6. The device of claim 4 wherein one of the said projections includes a separation therein operating upon inward deformation of the device to hold one of said components to said device.

7. A device for holding components together of a type having axially extending cavities therein including a one-piece metal stamping having three projections including first and second projections each extending in an axial sense relative to said cavities and each including a slot therewithin defining radially resilient beams with each beam including a radially extending barb adapted to engage the interior surface of a slot within the component into which such projection is inserted with the beam biasing said barbs into said surfaces to hold said projection to said components, the slots of the first and second projections being open at the ends thereof whereby the deformation inwardly of said slot draws the barbs on said projections radially inwardly to allow separation of said components, the third projection extending in a radial sense to define horizontal portions having horizontal surfaces for engaging horizontal surfaces of said components proximate said cavities to limit the displacement of said device in a given component whereby to hold said components together in a precise axial relationship each of said horizontal portions including at least one slot for receiving a tool adapted to deform said projection inwardly.

8. The device of claim 7 wherein at least one of said first and second projections is closed at the end thereof.

* * * * *

UNITED STATES PATENT AND TRADEMARK OFFICE

CERTIFICATE OF CORRECTION

PATENT NO. : 5,074,807

DATED : December 24, 1991

INVENTOR(S) : Kenneth R. Parmer

It is certified that error appears in the above-identified patent and that said Letters Patent is hereby corrected as shown below:

Claim 1, column 5, line 44 - delete the word "surface" and insert the word --surfaces--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*